United States Patent [19]

Racchini

[11] Patent Number: 4,706,076

[45] Date of Patent: Nov. 10, 1987

[54] APPARATUS FOR DISPLAYING IMAGES DEFINED BY A PLURALITY OF LINES OF DATA

[75] Inventor: Loriano Racchini, Turin, Italy

[73] Assignee: Ing. C. Olivetti & C., S.p.A., Ivrea, Italy

[21] Appl. No.: 651,318

[22] Filed: Sep. 17, 1984

[30] Foreign Application Priority Data

Sep. 30, 1983 [IT] Italy ..... 68005 A/83

[51] Int. Cl.[4] ..... G09G 1/16

[52] U.S. Cl. ..... 340/726; 340/748; 340/750

[58] Field of Search ..... 340/723, 724, 726, 744, 340/747, 750, 792, 731

[56] References Cited

U.S. PATENT DOCUMENTS

| | | | |
|---|---|---|---|
| 4,196,430 | 4/1980 | Denko | 340/726 |
| 4,284,988 | 8/1981 | Seitz et al. | 340/726 |
| 4,321,596 | 3/1982 | Hernandez et al. | 340/731 |
| 4,342,991 | 8/1982 | Pope et al. | 340/744 |
| 4,357,604 | 11/1982 | Imazeki et al. | 340/731 |
| 4,367,466 | 1/1983 | Takedo et al. | 340/724 |
| 4,375,638 | 3/1983 | O'Keefe et al. | 340/726 |
| 4,418,344 | 11/1983 | Brown | 340/726 |
| 4,491,834 | 1/1985 | Oguchi | 340/726 |
| 4,542,376 | 9/2985 | Bass et al. | 340/724 |

*Primary Examiner*—Gerald L. Brigance
*Attorney, Agent, or Firm*—Banner, Birch, McKie & Beckett

[57] ABSTRACT

Text is displayed on a VDU (23) using a character generator (26) and a generator (27) for attributes such as underline, enhanced brightness and so on. The codes for the generators are stored in a page store (29). Two auxiliary memories (35 and 36) are used to store address pointers. These memories are used in alternate raster scans to control the display, the unused memory being updated for the next raster scan. Each address pointer comprises an entry for every VDU scanning line and determines which dot video line signal will be used in that scanning line by specifying the data row address in the page memory (29) and the dot matrix row number to be used by the generators (26 and 27). Such address pointers enable complete control over the display for the purpose of defining windows, scrolling the display smoothly and slowly at the rate of one scanning line per frame and smooth expansion of a strip on the display by dulplication of lines. A CPU 10 effects the control by determining the address pointers written into the auxiliary memories. For graphics display, the address pointers store for each scanning line the number of the bit line to be used in creating the image.

7 Claims, 20 Drawing Figures

RAM
29
32
33
34
00
80
160
240
1920
35
36

CHAR. CODE
ATTRIB. CODE
UL
SLT
PL
OL
FD
FS
HL
CR

APPARATUS FOR DISPLAYING IMAGES DEFINED BY A PLURALITY OF LINES OF DATA

BACKGROUND OF THE INVENTION

The present invention relates to an apparatus for displaying images comprising a visual display unit producing an image by means of a raster scan, a page memory storing rows of data and means generating dot video line signals from the stored rows of data in synchronism with the display unit scanning lines. The invention may be used in the kind of apparatus in which an image or a text is compiled using entering means with the aid of a visual display unit (VDU) for facilitating modifications, insertions, deletions and combinations of parts.

There is known for this purpose apparatus of the aforesaid type in which the image can shift on the VDU, either the complete image or part only, that is limited to a window. Normally however, this shifting is too rapid, so that while the scrolling or other shifting is taking place, the image or text is incomprehensible.

In order to obviate this drawback, a visual display apparatus has been proposed in which coded alphanumeric data is recorded in the memory line by line. In each line there is moreover recorded an indication of connection with the following line of codes, so that by varying this indication vertical windows of the VDU can be defined. Moreover, in each line there is recorded a value indicating the number of scanning lines by which the characters in the line of the page memory must be shifted in the corresponding visual display strip. By incrementing or decrementing this value, slow scrolling of the image is obtained in the desired window. To this end, two line buffers are provided in which two lines of the memory are copies alternately, in such manner that each line of codes appears in the two buffers once as the first line and once as the second line. This arrangement requires a very complicated control circuitry and does not allow of varying the height of the characters on the VDU or of handling graphic images, in which the page memory stores each scanning line of an image.

SUMMARY OF THE INVENTION

The object of the invention is to provide an apparatus for visually displaying images which allows a large number of alphanumeric characters to be handled and which can also be used for graphic images, such as diagrams, drawings, etc.

The apparatus according to the invention is characterised by an auxiliary memory storing information individual to each scanning line and specifying for each scanning line which of the dot video line signals generatable from the stored rows of data is to be generated.

Each row of data may provide for a group of scanning lines which corresponds to a strip of the VDU. The information stored in the auxiliary memory in respect of each scanning line then consists of the address in the page memory of the row of data to be used in generating the dot video line signal and the line number within the group of the dot video line signal to be generated from the addressed row of data. The page memory can comprise for each strip a number of cells corresponding to the number of characters which can be displayed by the VDU in a strip, each cell being adapted to store a code of a character and a code of a related attribute.

According to a further development of the invention, a second auxiliary memory is provided for allowing the compilation of scan line information to be substituted for the first for the purpose of visual display of a page and means are provided for commanding vertical scrolling of the image on the VDU which shift the contents of the auxiliary memories one scanning line at a time in successive rasters, whereby the image in the VDU scrolls slowly, remaining legible.

BRIEF DESCRIPTION OF THE DRAWINGS

The invention will be described in more detail, by way of example, with reference to the accompanying drawings, in which.

DESCRIPTION OF THE PREFERRED EMBODIMENTS

The apparatus for visually displaying images is particularly suitable for facilitating the composition of texts and/or graphics which may require possible reprocessing with modifications, insertions, deletions and superposition of parts of the image. This apparatus can therefore be used in so-called personal computers, in terminals for collecting data and messages in general, in systems for composing typographical texts and in modern word processing systems, in which a text composed on a keyboard is stored to be subsequently printed, for example by means of an electronic typewriter.

Figure 1:
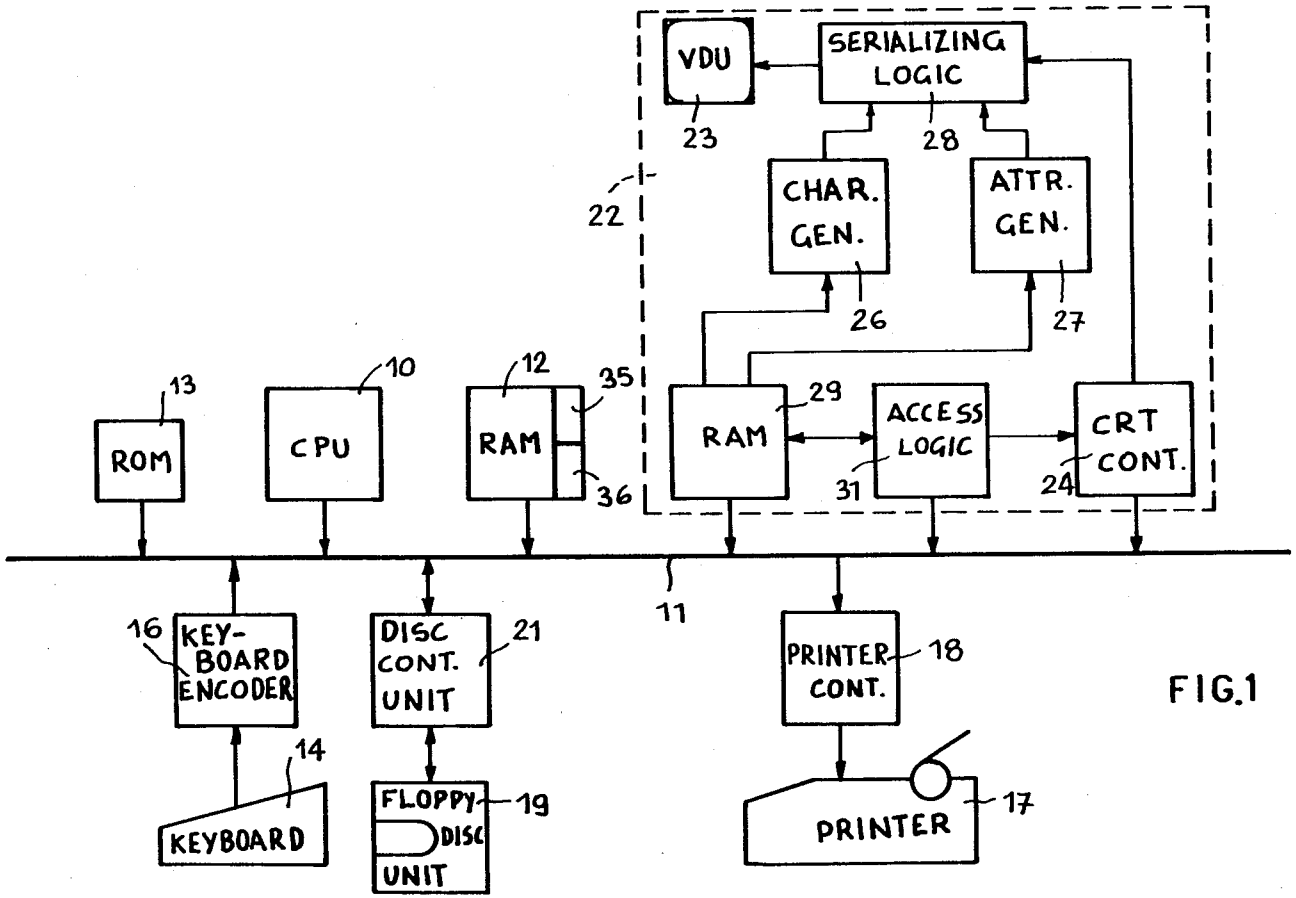
FIG. 1 is a block diagram of a work processing system incorporating an apparatus according to the invention for visually displaying images.

FIG. 1 shows, by way of example, a word processing system comprising a central processing unit (CPU) 10 constituted by a 16-bit microprocessor, for example the Intel 186 microprocessor. The CPU 10 is connected by means of a bus 11 to a read/write memory (RAM) 12 for containing the programs necessary from time to time for the working of the system and the coded data of the processing operations. To the bus 11 there is moreover connected a read-only memory (ROM) 13 for the microprograms of the system.

A series of peripherals adapted to be driven by the CPU 10 is furthermore connected to the bus 11. These peripherals comprise an alphanumeric keyboard 14 connected to the bus 11 through a keyboard encoder 16, a serial printer 17 connected to the bus 11 through a print control unit 18, and a mass memory, for example comprising at least one floppy magnetic disc unit (FDN) 19 connected to the bus 11 through a disc control unit 21, for storing permanently the program needed for the system. The FDU 19 is moreover adapted to store from time to time, under the control of the CPU 10, a series of texts as they are composed through the medium of the keyboard 14 in the RAM 12.

The apparatus moreover comprises a video unit 22, which includes a VDU 23, for example having a 30 cm cathode ray tube with a capacity of a page of 1920 characters arranged in 24 lines, each of 80 characters. The page VDU 23 is driven by a control unit (CRT controller) 24 known per se which determines the visual display line and field frequencies, horizontal and vertical synchronization pulses and signal levels. the video unit 22 moreover comprises a character generator 26 which contains at the address of each character the information relating to the dots of a matrix to be visually displayed on the VDU 23. The video unit furthermore comprises a printing attributes generator 27 which, together with the character generator 26 and the controller 24, is connected to the VDU 23 through a serializing logic unit 28, which will be better seen hereinafter.

Finally, the video unit 22 comprises a page memory constituted by a RAM 29 which is connected to the bus 11 and is adapted to be loaded with the codes of the characters and of the attributes to be visually displayed in a page. The RAM 29 is moreover accessible in asychronous manner by the CPU 10 for writing and reading the codes under the control of an access logic 31.

For visual display there has been chosen a 10×12 dot character matrix (FIG. 2) in which eight columns by ten rows are reserved for the character true and proper. One column on the left (column 0) and one column on the right of the matrix (column 9) define the minimum space between two adjacent characters, while a row of dots at the top (row 0) and a row at the bottom (row 11) provide the minimum space between two alphanumeric lines. Therefore, for each line of data or codes of alphanumeric characters, there is provided a group of twelve scanning lines, numbered in FIG. 2 from 0 to 11, which correspond to a strip of the VDU.

Figure 2:
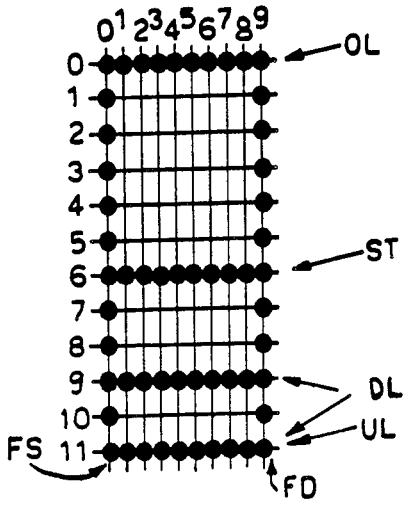
FIG. 2 is a diagram of the matrix of the characters and their attributes.
Figure 3A:
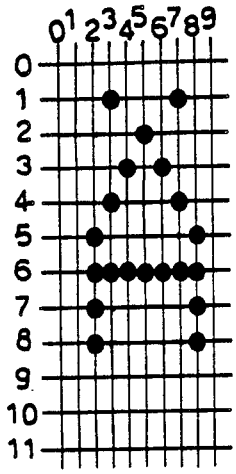
FIGS. 3*a*–3*d* show some examples of characters obtained with the matrix of FIG. 2.
Figure 3B:
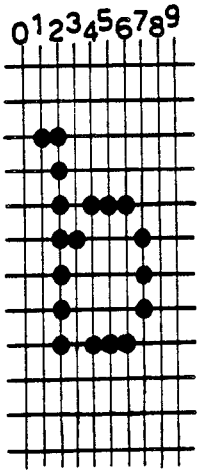
Figure 3C:
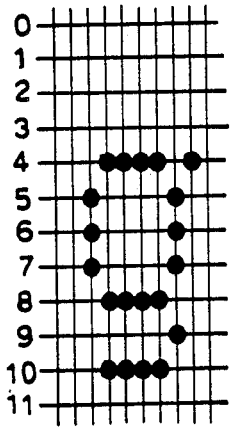
Figure 3D:
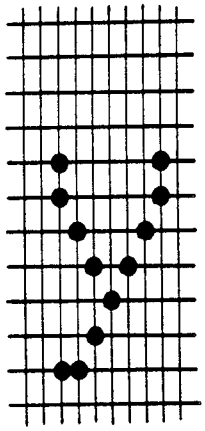

More particularly, an alphanumeric character normally occupies a maximum area of 7×10 dots, which area may be positioned so as to leave two columns free on the left, as in the case of FIGS. 3*a*, 3*c* and 3*d*, or on the right, as in the case of FIG. 3*b*, so as to improve the visual effect of the sequence of characters by making the spacing more uniform on the basis of the shape of the character itself. The ten rows of the character, on the other hand, are always positioned in the scanning lines 1–10 (FIG. 2), in which line 1 may be occupied only by the diacritical signs (FIG. 3*a*), while lines 9 and 10 may be occupied by the descenders of characters (FIGS. 3*c* and 3*d*).

Special characters are provided for, however, which also occupy the two end columns 0 and 9. There are moreover occupied in jointing characters, for example Arabic characters.

The dots to be visually displayed for each character are therefore defined, for each scanning line, by ten bits recorded in the character generator 26. This is adapted to generate 512 different characters which comprise, in addition to the standard alphabet of the ISO international code, the national characters of a plurality of languages, including characters with diacritical signs, the mathematical signs and the Greek alphabet. As is known, in the ISO code, many of the aforesaid characters are represented by the same bytes of the standard alphabet, following one or more command codes (for example, the command ESC). Other national characters of different languages, on the other hand, are represented by the same code, for which reason they can be used only alternatively. In any case, for direct addressing of the 512 characters of the generator 26, a nine-bit word is necessary, rather than a single byte.

The characters to be visually displayed may be provided with the following attributes, indicated diagrammatically in the matrix of FIG. 2: right column FD, left column FS, underlining UL, double underlining DL, overlining OL, cross bar ST. The following attributes which do not affect the character matrix are moreover provided: intensified character HL, reverse character CR. The attributes are normally coded in the ISO code with a byte preceding by a suitable ESC code, so that the attribute codes can be intercalated at will among the alphanumeric codes.

Figures 4A, 4B, 4C, 4D:
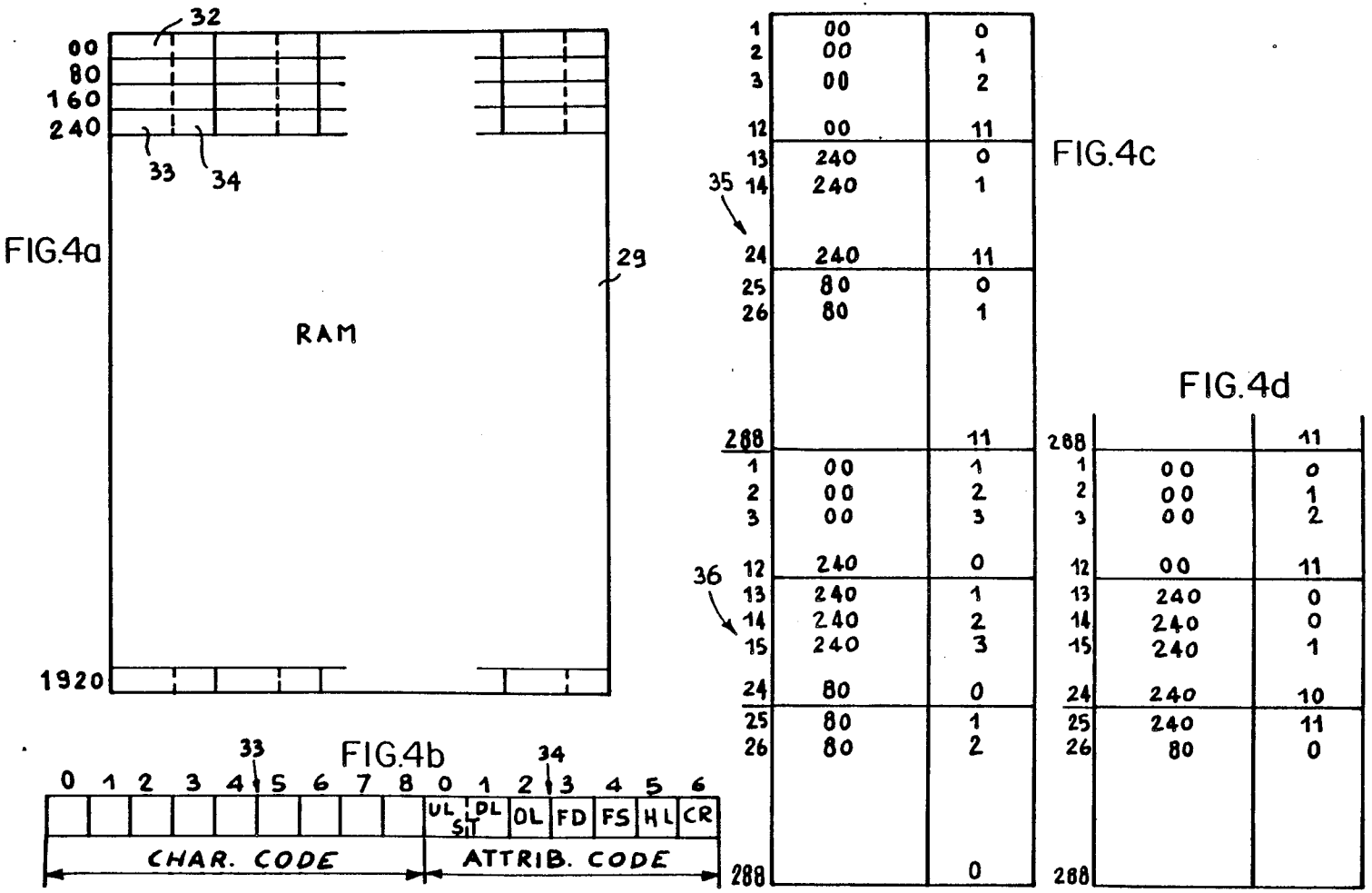
FIGS. 4*a*–4*d* are a diagram of the auxiliary memories driving the VDU.

The RAM 29 stores each character to be visually displayed in a corresponding cell 32 (FIG. 4*a*). Each cell 32 comprises a portion 33 for the code of the character and a portion 34 for the code of the respective attribute, so that all the elements necessary for commanding the visual display of the 10×12 dot matrix are available in the cell 32. The RAM 29 comprises twenty-five rows of cells 32 that is one row more than those which can be visually displayed, and every row comprises 80 cells 32. FIG. 4*a* indicates the address of the first cell 32 of each row, which thus constitutes the address of the row itself.

For the purpose of directly addressing the 512 characters of the generator 26, the portion 33 (FIG. 4*b*) of the cell 32 is constituted by nine bits for accepting a 9-bit internal character code, while the portion 34 of the cell 32 is constituted by seven bits for accepting an internal 7-bit attribute code.

According to the invention, the apparatus includes a pair of auxiliary memories 35 and 36 (FIG. 1), preferably constituted by two portions of the RAM 12, which are selectable for storing the address pointer of the page to be visually displayed. This address pointer (FIG. 4*c*) comprises for every VDU scanning line the address of the row of cells 32 of the RAM 29 and an indication of the scanning line of the character matrix (FIG. 2), which varies from 0 to 11 and addresses the character generator 265, as will be seen better hereinafter. Thus the numbers 1 to 288 correspond to the 24×12=288 scanning lines of the VDU 23, each of which has a corresponding memory cell containing firstly the row address of the RAM 29 (in the range 00 to 1920) and secondly the matrix row number in the 0 to 11. The order of the addresses of the rows of cells 32 which are stored in the auxiliary memories 35 and 36 is defined by the CPU 10 at the moment of recording and defines the sequence with which the lines of data must be displayed, for which reasons this sequence can be varied to create vertical windows on the VDU 23.

By way of example, in FIG. 4*a* the lines having codes 00, 80, 160, 120 . . . are recorded in the RAM 29, while a visual display address pointer in which the sequence of the addresses of the lines is 00, 240, 80 . . . is recorded in the auxiliary cross 35 (FIG. 4*c*). Each address is recorded twelve times with beside it the number of the scanning line from 0 to 11. The corresponding portion of the VDU 23, i.e. the first, second, third, . . . strips counting from the top, displays the characters of the codes of the lines 00, 240, 80, etc.

Figure 5:
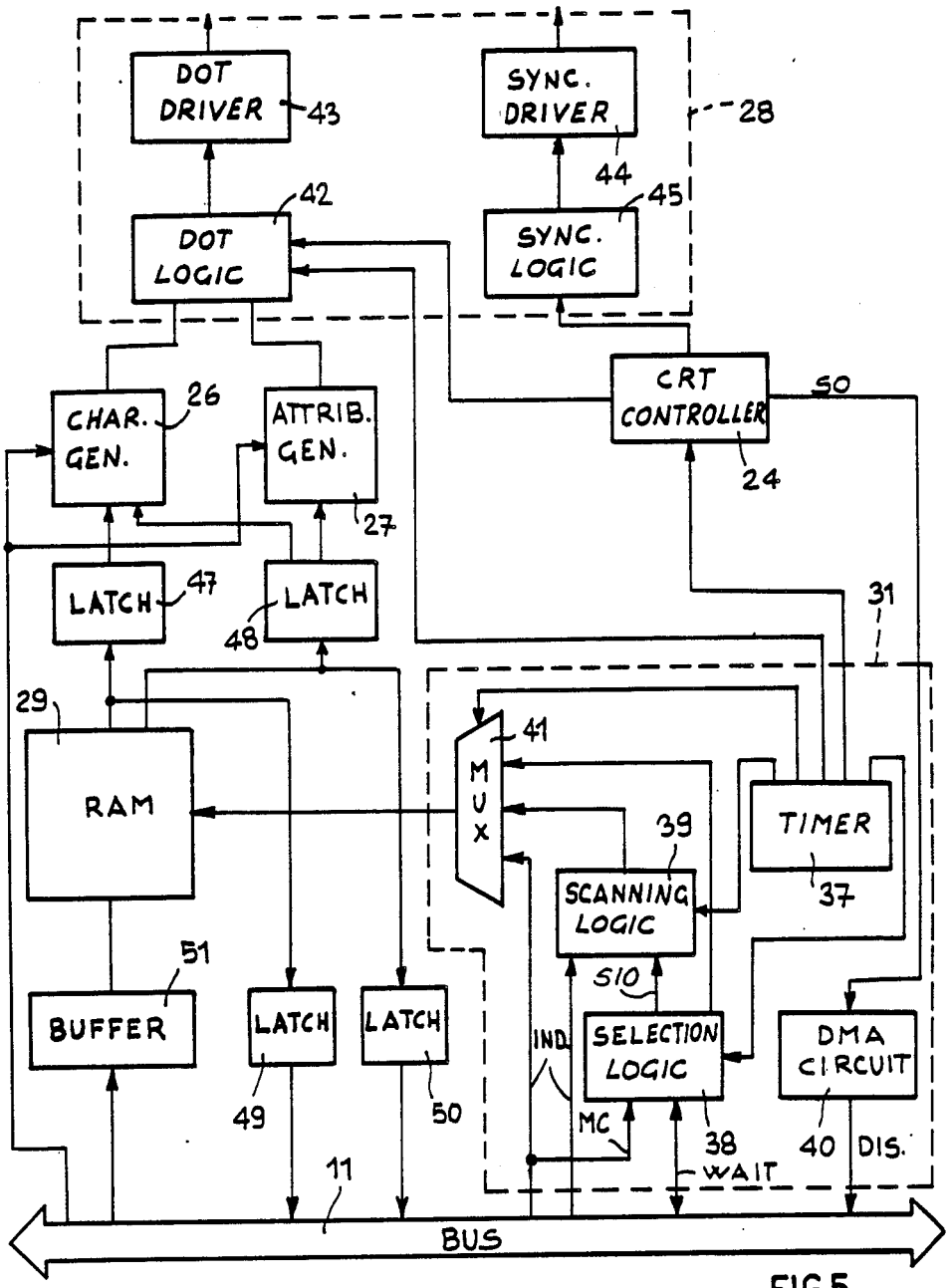
FIG. 5 is a logic diagram of the visual display apparatus.

The access logic unit 31 includes a timer 37 (FIG. 5) constituted by an 18,432 MHz oscillator. This supplies the basic timing signal TO (FIG. 6) having the same frequency, which controls the visual display or the dots. Thus TO is at the dot frequency which cyclically counts off ten signal periods P0 to P9. The timer 37 moreover generates seven staggered signals T1–T7, each with a period of 10×T0 and offset from one another by T0. The signal T1 defines the basic cycle of the unit, which is divided into two half-cycles: the half-cycle T1=1 substantially reserved for the running of the VDU 23 and the half-cycle T1=0 substantially reserved for the CPU 10 (FIG. 1) for access to the RAM 29.

Figure 6:
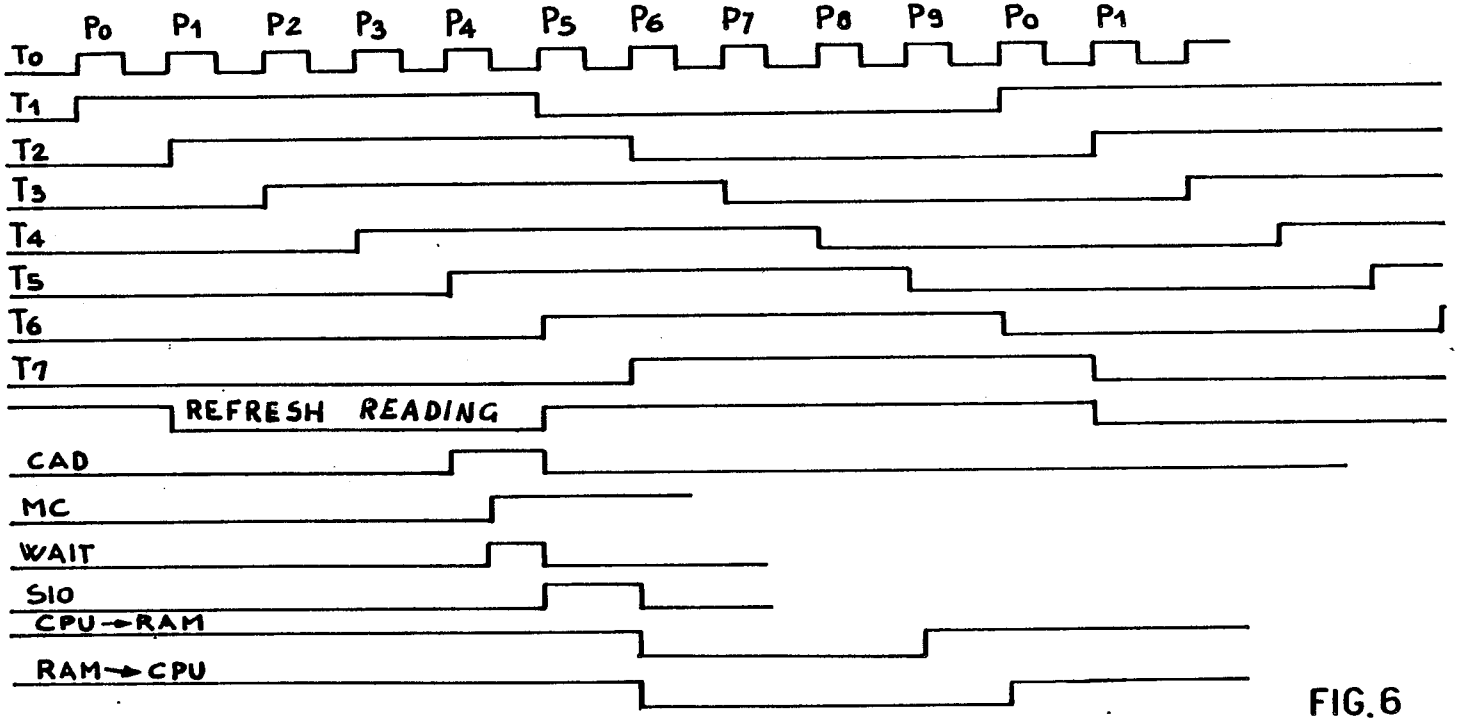
FIG. 6 is a timing diagram for some signals in the apparatus.
Figure 7:
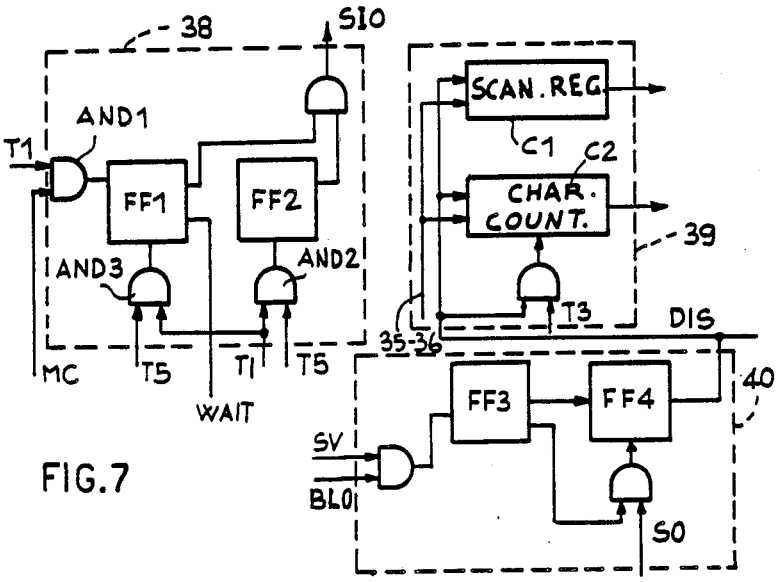
FIGS. 7 and 8 are two detailed diagrams of two portions of FIG. 5.

To this end, a request for access of the CPU 10 to the RAM 29 is generated by a request signal MC (FIG. 5) emitted by the CPU 10 and is controlled by selection logic 38 included in the access logic 31. The logic 38 comprises two flip-flops FF1 and FF2 (FIG. 7), of which FF1 is set via a gate AND 1 when it receives the signal MC in the presence of the signal T1=1. FF1 then emits a signal WAIT which blocks access of the CPU 10 to the RAM 29. The CPU 10 remains in this state until T1=T5=1 (FIG. 6). When this condition is met at the time T5=1, FF2 is set and FF1 is reset via gates AND2 and AND3. In this way, an access signal SIO is generated which allows the CPU 10 to access the RAM 29 for possible reading or writing operations in cells 32.

It is therefore clear that the WAIT time of the CPU10 depends on the instant when the signal MC is emitted. If this signal is emitted in the phase T1=T5=1 (FIG. 6), the request is attended to immediately. In any other case, the CPU 10 waits for the beginning of the following half-cycle T5=1. Access of the CPU 10 is thus synchronized with the operation of the video unit 22 (FIG. 1) in such manner that this access to the RAM 29 alternates with that of the unit 22 to the same RAM 29.

The selection logic 38 (FIG. 5) is moreover adapted to enable in the phase T1=1 a scanning logic 39 also included in the logic 31 and which comprises a register C1 (FIG. 7) for recording the scanning line given by the auxiliary memory 35 or 36 (FIG. 4*c*), and a counter C2 with a capacity of 4 Kilobytes for recording the address of the first character of a line given by the same auxiliary memory 35 or 36. As already seen, this address may be one of the multiples of 80, that is 0, 80, 160, 240, etc.

The loading of the register C1 and of the counter C2 (FIG. 7) takes place with direct access to the RAM 12 by the video unit 22. To this end, the CRT controller 24 (FIG. 5) is adapted to generate a horizontal synchronization signal SO every time the end of the visual display of a scanning line of the VDU is reached. By way of a DMA circuit 40, this signal generates a request signal DIS for the CPU 10 for direct access to the RAM 12, thus loading the register C1 (FIG. 7) and the counter C2. The latter is then incremented at each cycle at the T3=1, in concurrence with the signal DIS for addressing the following cells 32 (FIG. 4*a*) of the line. The counter C2 (FIG. 7) serves to address the page memory RAM 29 through a multiplexer 41 (FIG. 5) for the purpose of displaying and successively refreshing the image on the VDU 23.

The multiplexer 41 is changed over by the leading edges of the signals T1 and T5. In the time T5, reserved for possible access of the CPU 10 to the RAM 29, the address of the RAM 29 is sent on the multiplexer 41 directly by the CPU 10 itself, whereby access of the CPU 10 to the RAM 29 can alternate with the display of a scanning line of a character at any point of the page memory.

The DMA circuit 40 comprises two flip-flops FF3 and FF4 (FIG. 7) connected in such manner that, after initialization, if the VDU 23 is not blocked (signal BLO=0), the first request for access takes place after the vertical synchronization pulse SV of the CRT controller 24, while the following requests are controlled by the signal SO.

To this end, FF3 is set on reception of the vertical synchronization signal SV in concurrence with the signal BLO. FF3 being set, in concurrence with each signal SO, FF4 is set and emits the signal DIS requesting access to the CPU 10.

Figure 8:
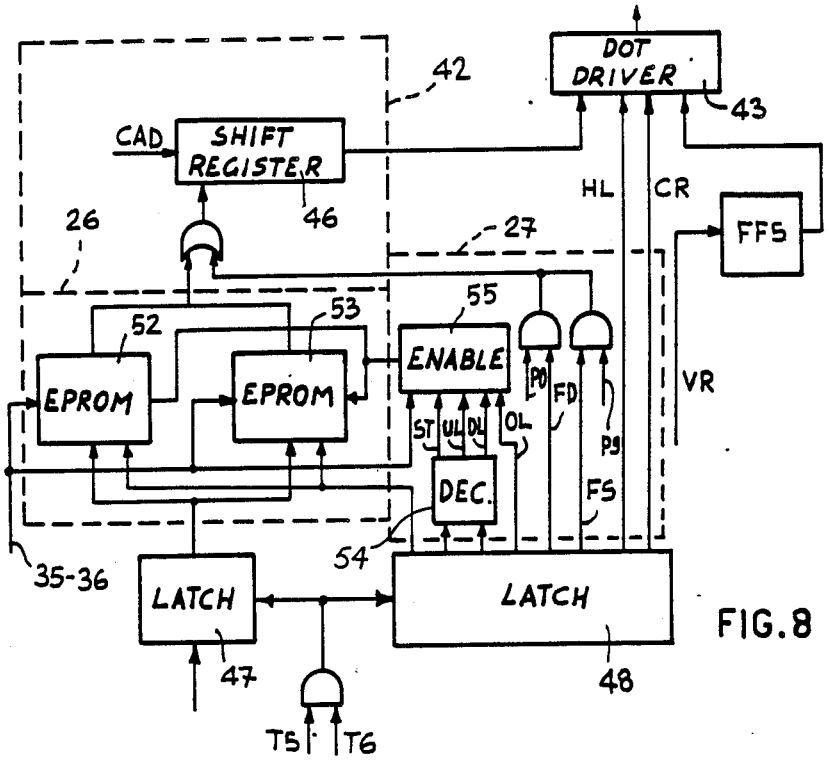

The serialization logic 28 (FIG. 1) comprises a dot display logic conduit 42 (FIG. 5) which is controlled by the CRT controller 24 to drive the electron beam of the VDU 23 through a driving circuit 43 enabled by the signals PO–P) (FIG. 6) of each cycle. The electron beam is enabled (unblanked) by a second driving circuit 44 (FIG. 5) controlled by a synchronization logic circuit 45. This is controlled by an enabling signal of the VDU given by the CRT controller 24, in such manner as to initiate the enabling of the electron beam at the beginning of each scanning sweep. The logic circuit 42 comprises a shift register 46 (FIG. 8) which is loaded at each cycle by the strobe signal CAD (FIG. 6) given by the timer 37 when T1=T5=1. The register 46 (FIG. 8) is loaded with the signals supplied by the character generator 26 and by the attributes generator 27 on the basis of the codes supplied by the cell 32 of the RAM 29. The address of the scanning line for the character generator 26 is given by the auxiliary memory 35 or 36, (as symbolized by the line 35-36) into which the CPU 10 has previously loaded the address pointer of the page to be displayed.

The character generator 26 is constituted by two EPROMs 52 and 53 (FIG. 8), each of 8K bytes, which are enabled in parallel with the same address. The EPROM 52 supplies to the register 46 the signals of the first eight dots of the scanning line of the character, while the EPROM 53 supplies the signals of the other two dots of the line.

In the phase T1=T2=1, the RAM 29 loads into two latches 47 and 48 the two bytes of the cell 32 addressed through the multiplexer 41 (FIG. 4) by the scanning logic 39. The signals of the latch 47 and of one bit of the latch 48 address the EPROMs 52 and 53, while the other seven bits of the latch 48 address the generator 27.

As already seen, the CPU 10 (FIG. 1) can access the RAM 29 in the half-cycle T5=1, both for reading a cell 32 for possible processing and for writing therein for the purpose of recording or modifying a datum. To this end, the two bytes of the cell 32 which are addressed directly by the CPU 10, through the medium of the multiplexer 41 (FIG. 5), are staticized in the phase T6=T7=1 (FIG. 6) in two latches 49 and 50 (FIG. 5) connected to the bus 11, while the two bytes of a datum to be transferred to a cell 32 are loaded in the phase T5=T7=1 (FIG. 6) into a two-byte buffer 51 (FIG. 5) connected between the RAM 29 and the bus 11.

The attributes generator 27 comprises a decoding circuit 54 (FIG. 8) for two bits of the latch 48 which is adapted to supply as output one of the signals UL for underlining, DL for double underlining and ST for the cross bar, so that these attributes cannot be generated simultaneously (see also FIG. 4(*b*)). The overlining attribute OL, on the other hand, is generated directly by a corresponding bit of the latch 48. The attributes of column to the right and left, the reverse character attribute and the intensified character attribute are also generated directly each by the corresponding bit FD, FS, CR and HL of the latch 48 (see also FIG. 4*b*). The signals ST, UL, DL and OL are sent to an enabling circuit 55 which is rendered active in correspondence with the scanning lines relating to the individual signals supplied by the memory 35 or 36. When the circuit 55 is rendered active, it disables the outputs of the EPROMs 52 and 53 and loads the shift register 46 directly with all the bits at 1. The signal FD and FS, on the other hand, force a bit at 1 into the register 46 only in concurrence with the dot signals P0 and P9, respectively. The intensified character signal HL commands the driving circuit 43 so as to increase the duty cycle of the video signal. The reverse character signal CR, on the other hand, commands the circuit 43 so as to invert the value of the bits issuing from the register 46.

A reverse video signal VR is supplied directly by the CPU 10 in response to a suitable command. This is staticized by a latch FF5 and commands the circuit 43 in a similar manner to the signal CR for the whole frame.

The CPU 10 (FIG. 1) normally loads an address pointer into the memory 35 when it loads the cells 32 of the RAM 29. Thereupon, while the memory 35 and the RAM 29 control the visual display, the CPU 10 can execute routines of updating of the address pointer by selecting the memory 36 and loading the new address pointer into it. At the next signal SV of the controller 24 (FIG. 5), the CPU 10 selects the memory 36 for control of visual display, while the memory 35 can be used for a subsequent updating of the address pointer. To this end, the keyboard 14 (FIG. 1) is equipped with two keys commanding upward and downward scrolling, respectively, of the image. The respective codes generated by the encoder 16 via the bus 11 are recognised by the CPU 10 which, in concurrence with a signal SV of the CRT controller 24, causes a counter controlling the recording of the scanning line in the auxiliary memory 36 to be incremented or decremented.

For example, in the case of the address pointer of the memory 35 of FIG. 4*c* being incremented, the CPU 10 copies in the memory 36 the addresses of the lines of the memory 35, but shifts the contents up by one scanning line so that each VDU strip now comprises dot matrix rows 1 to 11 of one row of characters plus row 0 of the next row of characters, as indicated in FIG. 4*c*. In this way, in the following refreshing operation, the image appears shifted upwards by one scanning line. This operation is repeated automatically twelve times, so that a shift of at least one VDU strip occurs at each scrolling command. In this way, the image of a scanning line shifts upward with a frequency of about 60 Hz, assuming this is the field frequency, so that a line of characters shifts in about 0.2 sec and a complete page in about 5 sec, that is in a manner sufficiently slow to keep the image legible during the shifting.

The keyboard 14 moreover comprises a command key for displaying the characters with double height. This command is associated with the address of the line of data to be displayed with double height, which is stored in a register of the RAM 12. In this case, the CPU 10 commands at each signal SV the updating of the memory 35 or 36 currently not selected for visual display. In this updating operation, the address pointer is copied by the CPU 10 as far as this address (in FIG. 4*d*, the scanning line 12), then the first scanning line of the line of data addressed is copied twice with the scanning line number 0 and, finally, in the following lines the scanning indication is incremented. In the following updatings, the next scanning line number 1 is recorded twice, and so on. Therefore, the line of characters of double height expands slowly, over a period of 5s while the following lines scroll slowly downward to make room.

The operations of updating of the address pointer for the scrolling of the display and for visually displaying a line of double height will now be described in detail.

Let it be assumed that the RAM 29 has been recorded with the page to be displayed and that the respective address pointer has been compiled in the memory 35, as indicated in FIG. 4*c*. The visual display is controlled by the latter and is refreshed at each signal SV.

Figure 9:
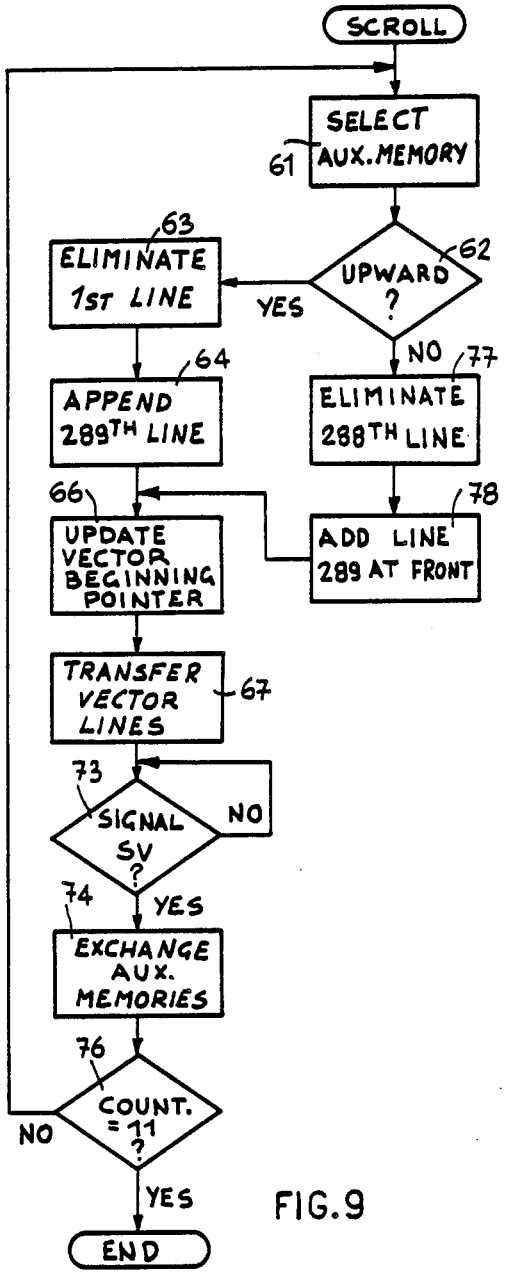
FIGS. 9 and 10 are two flow diagrams of two operations of the apparatus.

If the CPU 10 receives a scrolling command, it selects the routine shown diagrammatically in FIG. 9. First of all it effects a selection 61 of the auxiliary memory 35 or 36 currently not operative for visual display. It then effects a test 62 to establish whether upward or downward scrolling is concerned. In the first case, the CPU 10 eliminates the first line of the address pointer of the memory 35 (operation 63) and a 289th line is added after the 288th (operation 64). Then, a pointer P for the beginning of lines of the address pointer to be copied is updated, which is this case is entered at 1 (operation 66). The CPU 10 now enters the condition of transfer of the address pointer from the memory 35 to the memory 36 (FIG. 4*c*), thus transferring the lines of the new address pointer (operation 67 in FIG. 9). The CPU 10 then makes a waiting test 73 for the signal SV. When this signal occurs, an exchange of the operative memory 35 with the memory 36 is effected (operation 74), followed by a test 76 of a counter (in RAM) counting the number of shifted scanning lines. Until this counter is=11, the routine resumes from operation 61; on the other hand, when the counter reaches 11, if the scrolling command has ceased, the routine also ends.

If the result of the test 62 is negative (downward scrolling of the image), an operation 77 is first carried out in which the 288th line of the address pointer is eliminated. The 289th line is then added at the front (operation 78) and the routine continues with operation 66 as in the preceding case.

The above-described upward and downward scrolling can be limited to one or more windows entered, for example, through the medium of the keyboard. In this case, operations 63 and 64 or 77 and 78 are referred to the lines of the address pointer which correspond to the limits of the windows (i.e. to the set of VDU strips to be scrolled) instead of to those corresponding to the limits of the VDU page.

Figure 10:
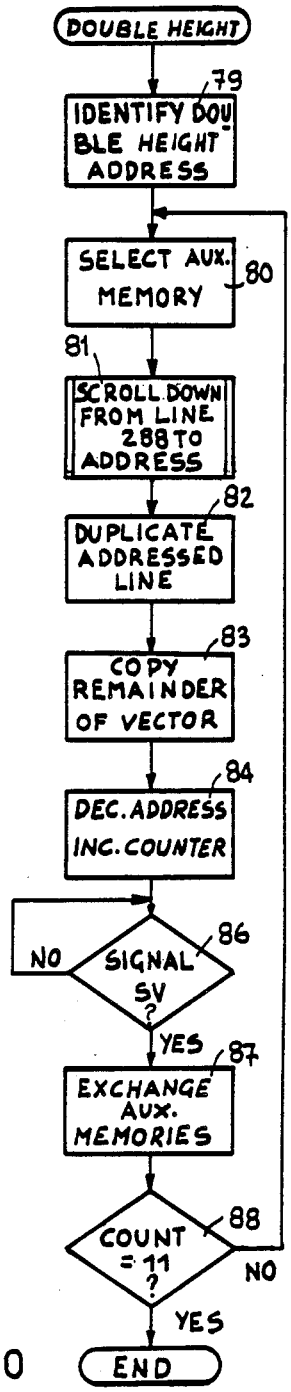

When a double-height command for a line of characters is entered, the CPU 10 first carries out an operation 79 (FIG. 10) of identification of the line of data to be modified and the corresponding address of the first higher line of the auxiliary memory 35, 36 is entered. Selection 80 of the auxiliary memory 35, 36 which is currently not operative is then effected. There is then carried out a routine 81 of downward scrolling from the 288th line of the address pointer to that of the address concerned. An operation 82 is now effected in which there is duplicated the scanning line "0" of the address in the line which has remained empty in the address pointer. An operation 83 of copying of the remaining part of the address pointer of the auxiliary memory is then effected. There is then carried out an opertion 84 in which the address concerned is updated by decrementing it and a counter of the RAM 12 indicating the number of scrolling operations effected is incremented. A waiting test 86 for the signal SV is now made and, when this signal occurs, an operation 87 of exchange of the memories 35 and 36 is effected, which is followed by a test 88 of the counter for the number of scrolling operations effected to establish whether its contents are equal to 11. As long as these contents are less than 11, the routine resumes from operation 80. On the other hand, when they are equal to 11, the routine terminates.

Figure 11A:
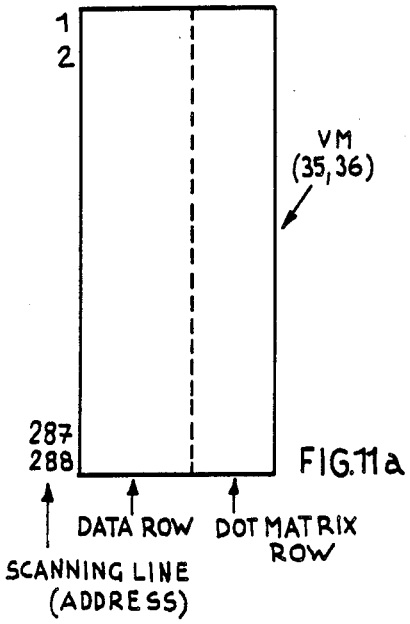
FIGS. 11*a*, 11*b*, 12*a*, and 12*b* illustrate the layout of the page memory and the auxiliary memory in the case of text and graphics respectively.
Figure 12A:
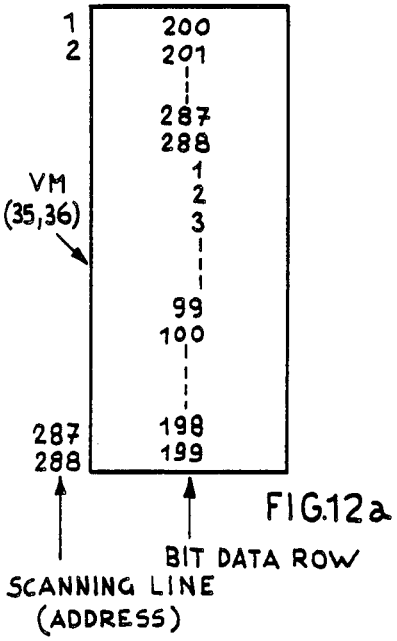
Figure 11B:
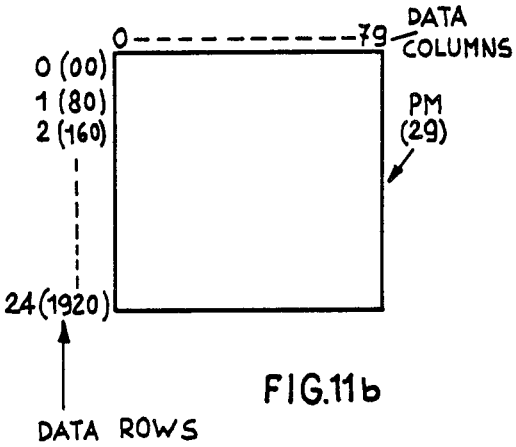
Figure 12B:
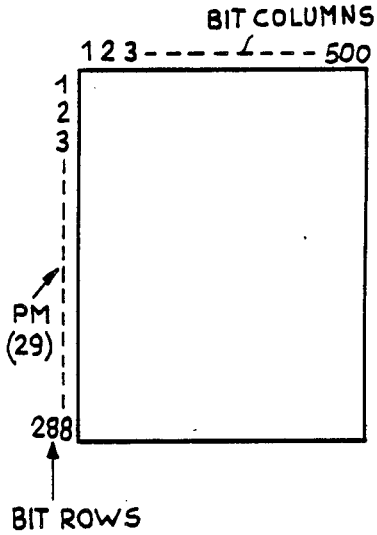

It is understood that various modifications may be made in the apparatus described without departing from the scope of the invention. For example, the RAM 29 (FIG. 1) and the character generator 26 and attributes generator 27 may be replaced by a bit chart memory for graphic images. In this case the address pointer memory stores the bit data row number for each scanning line. Moreover, any command for display of a character of multiple height of the VDU strip may be added to the double-height character command. FIG. 11*a* shows the generaly layout of the address pointer memory VM (i.e. the auxiliary memory 35 or 36) for the case of text display. As in FIG. 4, the memory addresses 1 to 228 correspond to the VDU scanning lines 1 to 228. The data stored at each address comprises two items, firstly the data row (in the page memory) and secondly the number of the dot matrix row, where the dot matrix rows are the rows 0 to 11 as in FIG. 2. FIG. 11*b* shows the page memory PM storing 25 rows times 80 columns of byte data. In the case of graphics the address pointer memory VM (FIG. 12*a*) again has addresses 1 to 228 corresponding to the VDU scanning lines. At each address there is stored simply the bit data row to be used from the page memory PM (FIG. 12*b*). It is assumed in FIG. 12*b* that the page memory PM stores an array of 288 rows of bits times 500 columns. By way of example, bit row numbers have been shown in FIG. 12*a* for a situation in which the displayed data is wrapped round vertically relative to the data stored in the page memory PM.

The routine of display of the double or multiple height characters may be carried out by a single exchange of the memories 35 and 36 by arranging the test 88 before the waiting test 86 for the signal SV.

Finally, the apparatus may be connected locally or in line with other apparatus or peripherals in which the data is recorded in the ISO codes. In this case, the apparatus comprises a program which, on the basis of the language chosen for the characters, allows the CPU 10 to transcode the data in the ISO code into the two byte internal code, which provides nine bits for the characters and seven bits for the attributes, by automatically allocating to the national character codes the internal codes relating to the characters.

I claim:

1. An apparatus for displaying images comprising a visual display unit for producing an image by means of a raster scan, a page memory for storing a plurality of rows of data, each row representing a corresponding strip of said image, and means responsive to the data so stored for generating video signals in synchronism with the display unit scanning lines, said generating means generating a group of successive dot video line signals from each stored row of data, wherein the improvement includes:

a pair of auxiliary memories individually conditionable for storing for each scanning line of the raster scan the address in the page memory of the row of data representing said strip of image, control means effective during one raster scan of said display unit for alternatively reading one of said auxiliary memories to sequentially address said page memory and for simultaneously conditioning the other one of said auxiliary memories to store the addresses of rows of data in the page memory to be displayed during the next following raster scan, and settable means for selecting a part of said other auxiliary memory and for storing therein the addresses of the page memory corresponding to at least a group of consecutive scanning lines shifted one scanning line in a selected direction with respect to those stored in the auxiliary memory being read.

2. Apparatus according to claim 1, including height expanding setting means operable for causing a selected group of lines of said image to be vertically expanded, said setting means when so operated causing said control means to duplicate during each raster scan the contents of one scanning line of the auxiliary memory in an adjacent scanning line and to shift one scanning line the contents of the subsequent other lines of the said group to accomodate the duplicated scanning line, whereby the image of said selected group is slowing vertically expanded.

3. An apparatus for displaying a plurality of rows of alphanumeric data, comprising a visual display unit for producing an image of each row of said data by means of a raster scan, a page memory comprising in respect to each row of data a number of cells corresponding to the number of characters which can be displayed in a horizontal line on said display, each row of cells being defined by the address in said page memory of the first cell of the row, each cell storing a character code and an attribute code individual to the character code of said cell, dot generating means responsive to the character codes of one line for generating a group of successive dot video line signals from the cells of each row, attribute decoding means responsive to the attribute codes of one line for altering the dot video line signals generated by said generating means, a pair of auxiliary memories conditionable for storing for each scanning line of the raster scan the address in the page memory of the row of data to be used in generating the dot video line signals and a line number within a group of dot video line signals to be generated from the addressed row of data, first control means operable during one raster scan for addressing said page memory with the addresses stored in a selected first one of said auxiliary memories and for causing said dot generating means to be jointly controlled by the data addressed from said page memory and by the line number read from said auxiliary memory, second control means for controlling the second one of said auxiliary memories during said one raster scan to store the addresses in the page memory of rows of data to be displayed during the next following raster scan, alternating means for alternating said first and second control means in controlling said first and second memories respectively, and settable means for selecting at least one part of said second auxiliary memory where the addresses of the page memory and the line numbers are stored shifted one scanning line in a selected direction with respect to those stored in said first auxiliary memory.

4. Apparatus according to claim 3, wherein each one of said cells includes a word formed of two adjacent bytes, said character code including one of said two bytes and part of the other one of said two bytes.

5. Apparatus according to claim 3, including a character height expanding setting means operable for causing the characters stored in a selected row of cells to be expanded in height, said second control means being conditioned by said setting means when so operated for duplicating during each raster scan in sequence in said second auxiliary memory the contents of one scanning line of said first auxiliary memory corresponding to said selected row of cells, and for shifting one scanning line in said second auxiliary memory the contents of the subsequent other scanning lines of said first auxiliary memory to accomodate the duplicated scanning line, whereby the characters of said selected row are slowly height expanded.

6. Apparatus according to claim 3, including a microprocessor for accessing said page memory as an alternative to said control means for modifying the data recorded in said page memory, said first and second control means and said alternating means being driven by said microprocessor in the execution of program routines rendered active by a manual command entered on said keyboard to operate said settable means.

7. Apparatus according to claim 6, wherein said auxiliary memories are formed of two zones of an operating memory associated to said microprocessor, said apparatus being included in a work processing system for facilitating the composition of texts to be printed, said system including a serial printer controlled by said microprocessor for printing characters corresponding to character codes addressed by said auxiliary memories.

* * * * *